US007493671B2

(12) United States Patent
Hurley et al.

(10) Patent No.: US 7,493,671 B2
(45) Date of Patent: Feb. 24, 2009

(54) ADJUSTABLE TROWEL ASSEMBLY

(76) Inventors: Donald Hurley, 314 S. K St., Lake Worth, FL (US) 33460-4549; Jose L. Gonzalez, 3033 Roberts Rd., West Palm Beach, FL (US) 33405

( * ) Notice: Subject to any disclaimer, the term of this patent is extended or adjusted under 35 U.S.C. 154(b) by 245 days.

(21) Appl. No.: 11/550,113

(22) Filed: Oct. 17, 2006

(65) Prior Publication Data

US 2007/0061988 A1 Mar. 22, 2007

Related U.S. Application Data

(63) Continuation-in-part of application No. 11/339,147, filed on Jan. 24, 2006, now abandoned, which is a continuation-in-part of application No. 11/231,996, filed on Sep. 21, 2005, now abandoned.

(51) Int. Cl.
*B05C 17/10* (2006.01)

(52) U.S. Cl. ..... 15/235.6; 15/235.8

(58) Field of Classification Search ..... 15/235.4, 15/235.6, 235.8
See application file for complete search history.

(56) References Cited

U.S. PATENT DOCUMENTS

| | | | |
|---|---|---|---|
| 2,167,996 | A | 8/1939 | Pritz |
| 3,916,472 | A | 11/1975 | Carder |
| 5,231,729 | A | 8/1993 | Rose |
| 5,450,648 | A | 9/1995 | Dovin et al. |
| 5,699,580 | A | 12/1997 | Silverstein |
| 5,807,022 | A | 9/1998 | McCleary |
| 6,178,586 | B1 | 1/2001 | Jafarmadar |
| 6,505,408 | B1 | 1/2003 | Talamantez et al. |
| 2003/0210952 | A1 | 11/2003 | Hsiao |

FOREIGN PATENT DOCUMENTS

| | | |
|---|---|---|
| GB | 2259938 | 3/1993 |

*Primary Examiner*—Laura C Guidotti
(74) *Attorney, Agent, or Firm*—McHale & Slavin, P.A.

(57) ABSTRACT

An adjustable trowel assembly capable of distributing spreadable material along the work surface at various depths and/or different groove patterns formed in the material by simply adjusting the two overlapping sliding plates of the assembly relative to each other. More particularly, the instant invention is drawn to an adjustable trowel wherein the two adjustable plates are aligned and held together by quick release cam clamps placed into the handle.

15 Claims, 12 Drawing Sheets

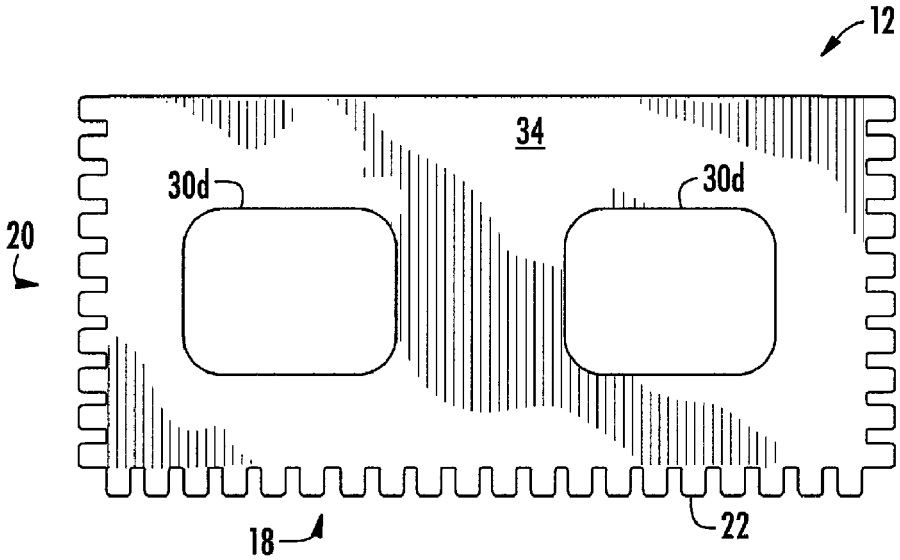
FIG. 12
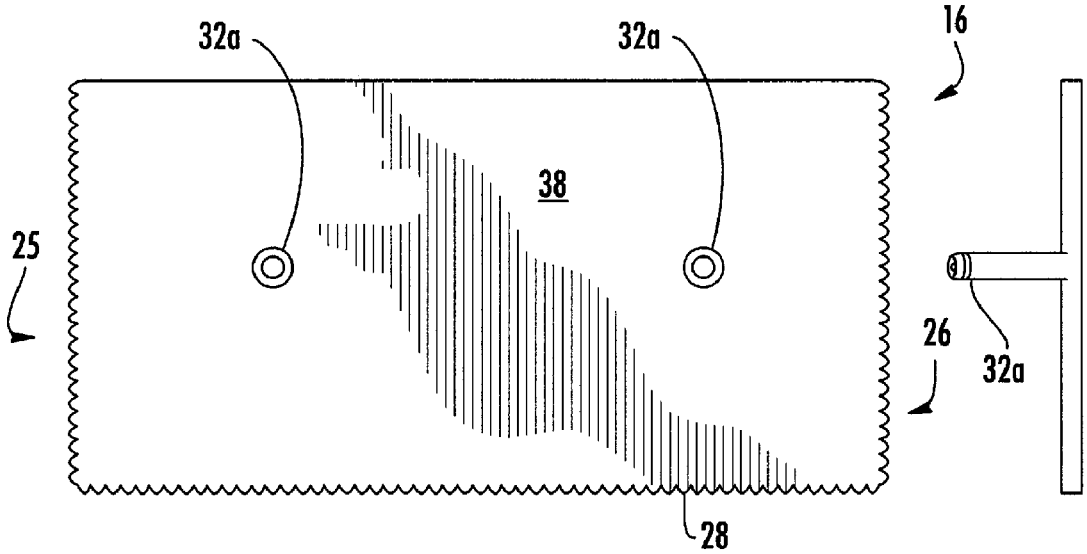
FIG. 13a
FIG. 13b

ADJUSTABLE TROWEL ASSEMBLY

CROSS REFERENCE TO RELATED APPLICATION

This application is a continuation-in-part of U.S. patent application Ser. No. 11/339,147, filed Jan. 24, 2006, now abandoned, which is a continuation-in-part of U.S. patent application Ser. No. 11/231,996, filed Sep. 21, 2005, now abandoned, the contents of which are herein incorporated by reference in their entirety.

FIELD OF INVENTION

This invention relates to a trowel assembly for distributing spreadable material onto virtually any work surface. Particularly, this invention relates to an adjustable trowel assembly capable of distributing spreadable material along the work surface at various depths and/or different groove patterns by simply adjusting two overlapping plates of the assembly relative to each other. More particularly, the instant invention is drawn to a trowel assembly capable of being adjusted for left- and right-handed uses.

BACKGROUND OF THE INVENTION

Hand trowels are commonly used in the building and do-it-yourself industry to distribute spreadable material (e.g., adhesives, plaster, grout, fillers or the like) along a work surface (wooden or cement subfloors, walls, etc.) A typical trowel is of a single, rectangular plate-like configuration having at least one notched edge in the form of a square or saw-tooth configuration. Often these trowels include only one notched side edge sized and selected for their particular thickness of spread. Recently, however, trowels have been manufactured to include two different sides with different sized notching. Notches having a larger distance between them create a thicker layer of material, and those having a smaller distance between the notches spread thinner layers of material.

For example, a person using a conventional trowel for applying tile, brick, block or the like, uses it to scoop out the necessary amount of adhesive material onto the work surface. The user then holds the trowel such that the notched side edge of the trowel makes adequate contact with the adhesive and pulls the notched edge along the adhesive to create the grooves (or ridges) in the adhesive. The notch's size and shape determines the depth of the resulting ridges and should be appropriate to the type and size of the tile being installed. Generally, for tiles of less than 10 in., one would use notches with dimensions of ¼×¼ in.; for tiles between 10 and 14 in., use ⅜ in. ×¼ in. trowel; and for tiles larger than 14 in. use a ½×½ in. trowel. Previously, should a tiler need to adjust the depth or shape of the resulting grooves in the adhesive, the user would need to employ a second trowel having the desired notch characteristics (e.g., depth or shape). The user is unable to adjust the trowel notch configuration to vary the resulting depth of the grooves in the spreadable material.

When trying to apply the spreadable material into internal corner joints defined by two planar surfaces meeting at a fixed angle, the user has been limited to pre-manufactured right- or left-handed trowels having two adjacent notched edges. Because of the difficulty of positioning two adjacent notched edges in corresponding internal corners, the worker will often have to employ two separate trowels, (i.e., a left-handed trowel and right-handed trowel) each of which are notched at oppositely, adjacent edges to access the corresponding internal corners of the structure.

It has been proposed to provide trowel assemblies comprising two removable and interchangeable plate-like members, one plate having at least one threaded post and the other plate having at least one corresponding slot for slidably receiving the post, wherein the two plates are held stationary relative to each other at the desired position using a wing-nut that engages the threaded post. However, unlike the instant invention which utilizes quick release cam clamps that engage threaded or non-threaded posts, the wing-nut type attachments of the prior art are time consuming to attach, and the threads often become fouled with the material being applied. Thereby, making the wing-nut difficult to rotate about the threads. In addition, during the cleaning process the plate-like members of the assembly must be completely disassembled which can lead to the trowel assembly components (e.g., wing nuts, plates) becoming lost or misplaced.

The instant invention allows the user to modify the notch configuration such that the depth of material being applied can be varied over a wide range until the desired depth is attained. The user is able to employ either the notches formed on the first or second plate-like members alone or in overlapping combination to obtain different groove configurations. The present trowel assembly also allows the user to readily expose the appropriate notched edges of adjacent sides of the trowel assembly to provide a right- or left-handed configuration using a single trowel. In addition, the plates and the quick release cam clamp of the assembly remain connected yet separable so as to allow for easy cleaning therebetween without the possibility of one of the plate-like members becoming lost or misplaced.

DESCRIPTION OF THE PRIOR ART

Currently there are a few patents directed toward trowel assemblies that are capable of adjusting the depth of the spreadable material as well as the shapes of the resulting grooves created in the spreadable material by the edge of the trowel. For example, U.S. Pat. No. 5,231,729 to Rose discloses a tilers trowel having at least one edge which is notched, wherein an adjustment means is provided for limiting the depth of material which can be applied by adjusting the size of the notching by sliding two plate-like members relative to one another. Adjustment occurs by way of loosely held posts which pass through holes in the lower plate and move along slots in the upper plate, covering the plates to move relative to one another. However, unlike the instant invention which utilizes an integrate and attached quick release cam clamps designed to engage threaded or non-threaded posts, the wing-nut/post type attachment of the aforementioned patent is time consuming to attach and remove, and often becomes occluded with the material being applied making them difficult to rotate about the threads. Moreover, the movement of the two plates is limited to predetermined direct-ions defined by the slots, thereby limiting the user to strictly right- or left-handed operation of the trowel assembly. The multi-directional slot configuration and enlarged cutouts in the plate-like members of the present invention allow the user to move the plates between left- and right-handed operations as desired. This is especially advantageous when the user needs to access internal corner joints defined by two planar surfaces.

GB 2,259,938 to Phillips, is drawn to a trowel assembly comprising a base having edges with notches therein and an un-notched obturator which resides atop the base and movable relative thereto to vary the effective size of the notches. The base has upstanding studs which mate with guiding slots formed in the obturator. However, like the aforementioned patent, the obturator is attached to base by a wing-nut type attachment. Additionally, the invention to Phillips differs from a particularly preferred embodiment of the present invention whereby the handle is slidably attached to the upstanding fastening means of the second plate-like member. Thus, the trowel assembly can be cleaned without having to be completely dissembled so that the component parts are not lost or misplaced.

U.S. Pat. No. 2,167,996 to Pritz discloses a trowel onto a top face is attached a pair of comb-like plate members comprising spaced apart fingers or teeth. The fingers or teeth are spaced apart in accordance with the spacing between the openings in the fold at the longitudinal edges of the blade so as to register with and pass or extend through the openings. By loosening the nuts the members can be shifted inwardly or outwardly beyond the edges of the blade. This length and angular position in which the user holds the trowel determines the depth of the ridges of material formed.

U.S. Pat. No. 3,916,472 to Carder discloses a trowel for spreading adhesives for floor and/or wall coverings. It comprises a handle having a base section, and an integral handgrip. A rhomboidally shaped spreading blade is releasably and reversibly attached to the bottom of the base section, and has serrated edges for spreading adhesive in striated form on a surface. A plurality of spaced slots in the blade is insertable over the heads of a plurality of screws that project from the bottom of the base section. Two of the screws latch the blade in place in either of two different operating positions, when the blade is shifted laterally relative to the handle. A third one of the screws is threadable into a bore in the base section releasably to secure the blade against movement on the handle when the blade is latched in either operating position.

U.S. Pat. No. 6,178,586 to Jafarmadar discloses a handheld trowel that includes first and second adjoining edges that have a plurality of notches disposed therein that is used to provide grooves in cementious material, the trowel used for spreading cementious material and the trowel including a third edge extending away from the trowel body having sufficient rigidity and strength for prying up a ceramic tile for use as a margin trowel. The trowel also includes a handle for grasping by hand that is rigidly attached to the trowel body which may include a level indicating device to tell with an air bubble and liquid whether or not the fourth edge of the trowel, which is straight when placed on the surface of a tile, is level relative to the gravitational field of the earth.

While the foregoing described prior art trowels may have advanced the art in a variety of ways, there nevertheless remains a need for an adjustable, left- and right-handed trowel capable of applying a spreadable material at a predetermined thickness in a predetermined pattern while remaining capable of being readily separated for thorough cleaning by the user after application of the spreadable material without fear of losing one of its component parts.

All patents and publications are herein incorporated by reference in their entirety to the same extent as if each individual publication was specifically and individually indicated to be incorporated by reference.

SUMMARY OF THE INVENTION

Consequently, in response to the aforementioned problems found in the prior art, it is an objective of the instant invention to provide an adjustable, equipoise (i.e., left- or right-handed) trowel assembly capable of distributing a spreadable material onto a work surface at various depths and/or with different groove patterns. According to one embodiment, the trowel assembly may be readily separated, yet not completely dissembled, for easy cleaning.

The adjustable trowel assembly of the instant invention includes an upper, first plate-like member having an upper surface with at least one multi-directional slot or enlarged cut-out portion therein, a bottom surface, and a pair of spaced apart side edges, wherein at least two of the adjacent side edges include a plurality of notches. According to a preferred embodiment, the cut-out portion has a substantially rectangular or square shape.

The assembly includes a lower, second plate-like member of approximately the same dimension as the first plate-like member. The second plate-like member having an upper surface with at least one fastening means (post, stud, pin, etc.) integrally connected thereto and projecting upward therefrom at a location which corresponds to the multi-directional slot or enlarged cutout portion in the first plate-like member. The second plate-like member further includes a bottom surface, and a pair of spaced apart side edges wherein at least two of the adjacent side edges include a plurality of notches.

The trowel assembly includes a handle. According to one embodiment, the handle is integrally connected to the upper surface of the first plate-like member. More preferably, the handle is slidably attached to the fastening means of the second plate-like member, so that the plates may be separated after use for easy cleaning yet remain connected so that no part of the assembly is lost. The handle may also include at least one level indicating means integrally connected thereto such that the user may place any of the side edges or bottom surface of the second plate-like member of the assembled trowel assembly against a work surface to determine whether the surface is, in fact, level and/or plumb with respect to the earth. This is especially advantageous when using the trowel assembly of the instant invention to install tile onto a work surface, such that, once the tile are in place the trowel itself can be placed against the installed tile to ensure it is level and/or plumb without having to employ a separate level.

The trowel assembly includes a plurality of simple, quick release cam clamps which correspond with the plurality of fastening means integrally attached to the second plate-like member, such that the first plate-like member may be adjusted relative to the second plate-like member along parallel planes to provide the desired amount of overlap between corresponding notched side edges of the first and second plate-like members. This provides the user with a means to easily and quickly disassemble the trowel, which may prove advantageous when working with fast-setting (or curing) spreadable material, so that the two plate-like members do not become permanently adhered together.

It is another objective of the present invention to teach at least one multi-directional slot formed in the first plate-like member for providing a trowel assembly for left- or right-handed use; this is particularly advantageous for positioning adjacent notched edges of the trowel in various corresponding corner joints, wherein two planar surfaces meet at a particular angle.

It is a further objective of the instant invention to provide a trowel assembly wherein the first and second plate-like members each comprise notches of a disparate size along their respective edges whereby the user can chose the appropriate notch size available on one of the two plates, or create a unique notch size by overlapping the two plates.

It is yet another objective of the current invention to provide a trowel assembly wherein the first and second plate-like members each comprise different shaped notches available on either of the two plates or create a unique notch shape by overlapping the two plates.

Another objective of the instant invention is to provide a trowel assembly that is capable of being utilized to apply plasters, cementatious materials, grouts or the like.

Yet still another objective of the present invention is to teach an embodiment of the trowel assembly that protects the user from the moving parts of the cam clamp.

Another objective of the present invention is to disclose an aesthetically appealing trowel assembly that more closely resembles commercially available single plate trowels.

It is still a further objective of the invention to provide a trowel assembly wherein the handle may include at least one level indicating means integrally connected thereto so that the user may place one of the surfaces of trowel assembly against the work surface to determine whether it is level and/or plumb with respect to the earth.

Yet another objective of the instant invention is to provide a trowel assembly wherein the bottom surface of the second plate-like member is a smooth surface in order that this surface may be used to smooth out the spreadable material, which can be particularly advantageous when using the instant assembly for plastering.

An additional objective of the present invention is to provide a trowel assembly that is economical to manufacture in that it has few components or complicated moving parts.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE FIGURES

FIG. 2*a* is the same side view of the trowel assembly shown in FIG. 2*a*, wherein the cam clamp is in a "closed" position, such that the first and second plate-like members are affixed relative to each other;

FIG. 12 is a top view of the first plate-like member in accordance with a third embodiment showing the two enlarged substantially rectangular cut-out portions 30*d;*

FIG. 13*a* is a top view of the second plate-like member in accordance with the third embodiment showing the two fastening means which correspond and are received in the cutout portions 30*d* shown in FIG. 12;

FIG. 13*b* is a side view of the second plate-like member shown in FIG. 13*a;*

DETAILED DESCRIPTION OF THE PREFERRED EMBODIMENTS

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
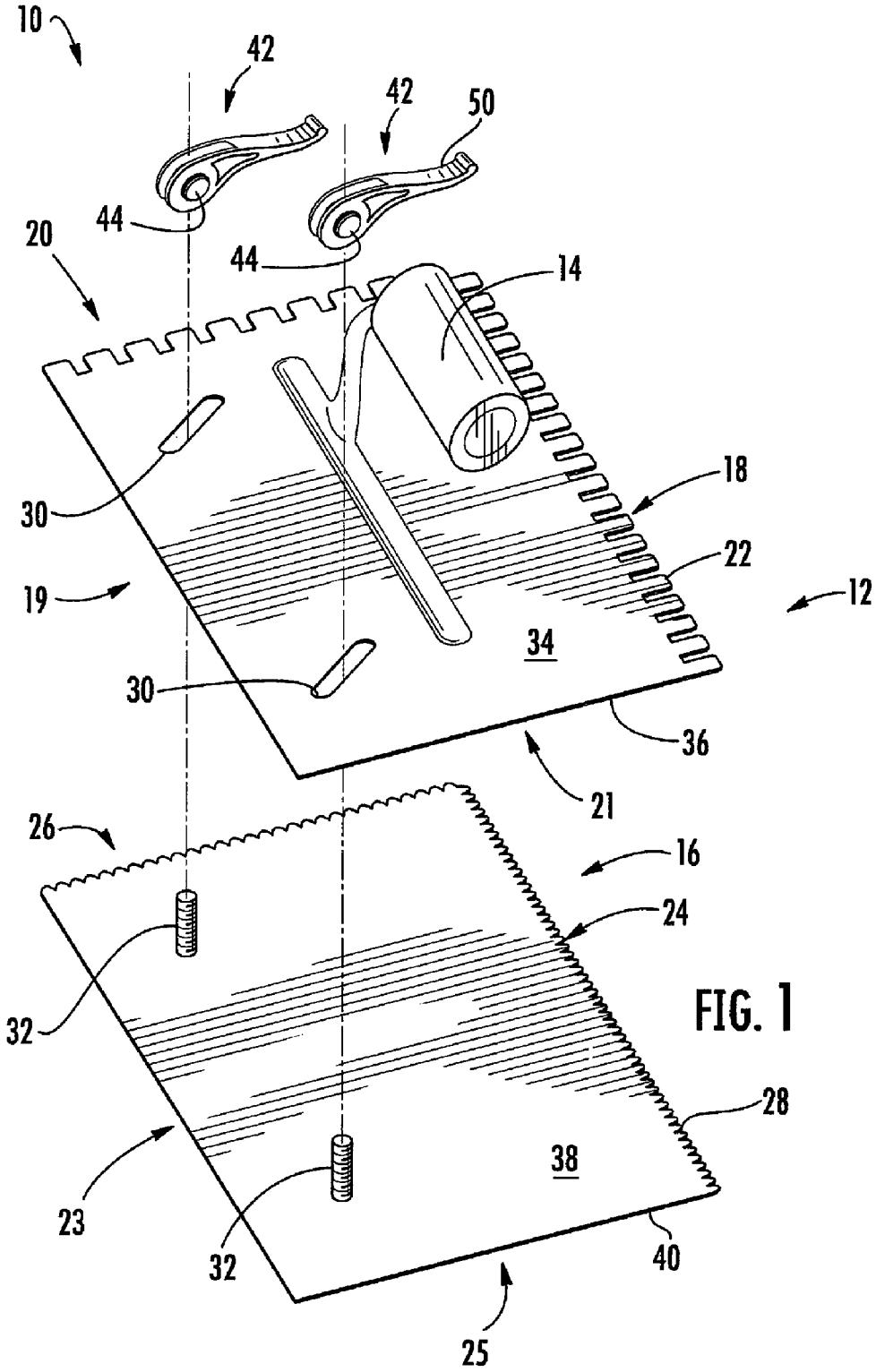
FIG. 1 is an upper perspective, exploded view of a trowel assembly according to one embodiment of the invention.

Referring now to FIGS. 1-6, wherein like elements are numbered consistently throughout, FIG. 1 shows an exploded, upper perspective view of one embodiment of the instant trowel assembly, generally referenced as 10. The trowel assembly shown herein is capable of applying an even distribution of spreadable material onto virtually any work surface (e.g., wall, floor, etc).

The trowel assembly comprises an upper, first plate-like member 12 comprising an upper surface 34 and a bottom surface 36 with a handle 14 integrally connected to the upper surface 34 by any means of attaching known in the art, for example, welding, adhesives, rivets, etc. As shown herein, the first plate-like member 12 includes two adjacent edges 18, 20 having substantially rectangular notches 22 formed therein, useful for installing larger tiles. The first plate-like member also includes oppositely adjacent edges 19, 21, shown here without any notches.

The assembly 10 further includes a second, lower plate-like member 16. The second plate-like member 16 includes an upper surface 38 and a bottom surface 40. As with the first plate-like member, the two adjacent edges 24, 26 of second plate-like member 16, shown here provided with smaller serrated notches 28 suitable to spread the material in a striated form often used when installing smaller tiles, however, other shapes (v-shaped, scalloped, etc.,) could be used without departing from the scope of the instant invention. Again, the second plate-like member includes oppositely adjacent edges 23, 25, shown here without any notches formed therein.

Referring again to FIG. 1, the first plate-like member 12 is provided with at least one diagonal elongated slot 30 formed therein, shown here as two parallel slots. The second plate-like member 16 has a corresponding number and size of fasteners 32, such as posts, pins, bolts, studs, or the like, known to those skilled in the art. The fasteners 32 are integrally attached to the upper surface 38 of the second plate-like member by any means of attaching known to the skilled artisan, e.g., welding, rivets, adhesives, or the like, in order that the bottom surface 40 of the plate-like member has a smooth surface, useful for creating an even and smooth surface on the spreadable material if preferred.

Figure 2A:
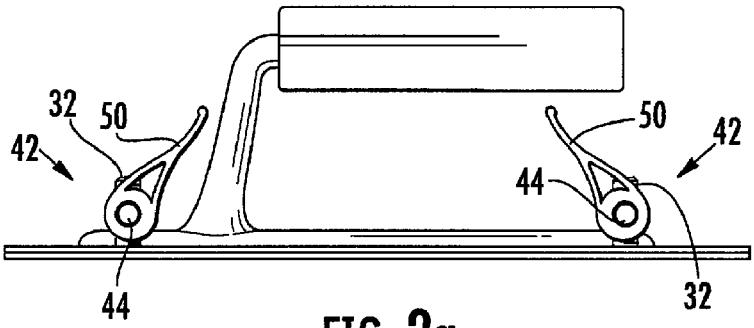
FIG. 2*a* is a side view of the trowel assembly of FIG. 1, wherein the cam clamp is in an "open" position, such that the first and second plate-like members are not affixed relative to each other.
Figure 2B:
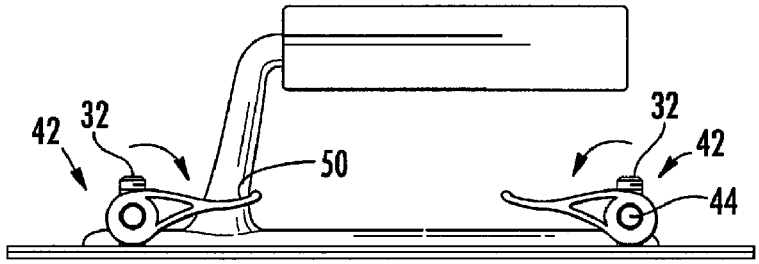

Upon assembly, the user places the first plate-like member 12 above the second plate-like member 16 such that the slots 30 in the first plate-like member are aligned with the threaded fasteners 32 on the second plate-like member. The user places the fasteners through the slots 30 in the first plate-like member. Next, the user places the two cam clamps 42 over each of the fasteners 32, as shown in FIG. 2*a*, shown in the "open" position. When shaft of the fastener is translated along the slot to the desired position within the slot, the user pivots the lever portion 50 of the cam clamp along its horizontal axis to the "closed" position, as shown in FIG. 2*b*.

Figure 3:
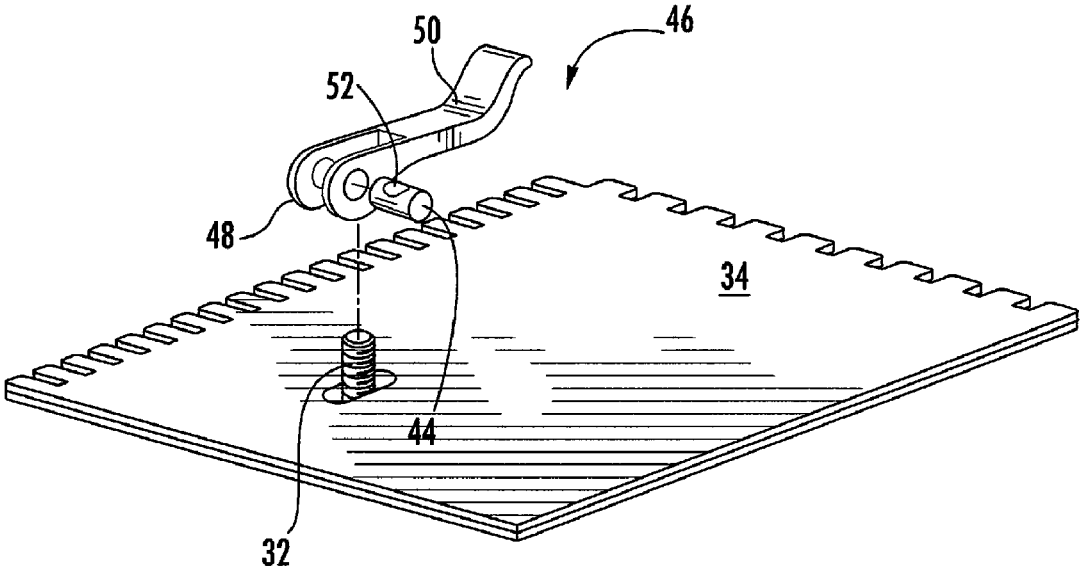
FIG. 3 is an upper perspective view of the trowel assembly of FIG. 1, illustrating an exploded view of the cam clamp used to affix the two plate-like members of the trowel assembly.

One such cam clamp 42 (like those sold by Rockler®, Minnesota) is shown in detail at FIG. 3. This cam clamp includes a cross dowel 44 sized for receipt within the cam portion of the clamp. The dowel 44 includes a threaded aperture 52, along the vertical axis of the dowel, adapted to engage the threaded surface of the fastener 32, which is integrally attached to the upper surface 38 of the second plate-like member 16. Attachment of the cam clamp is created by the force of the gradual curved surface or throw 48 against the upper surface 34 of the first plate-like member 12 onto the fastener 32, upon pivoting the lever portion 50 toward the closed position, thereby affixing the first and second plates relative to each other.

In an alternative embodiment, a washer (not shown) can be placed juxtaposed to the throw 48 and the 34 upper surface of the first plate-like member to protect the upper surface 34 from becoming worn upon repeated actuation of the lever. The cam clamp of the instant invention is an improvement over conventional types of means of attachment, including wing nuts, which are time consuming to assemble and often become occluded with the material being applied making them difficult to rotate about the screw.

Figure 4:
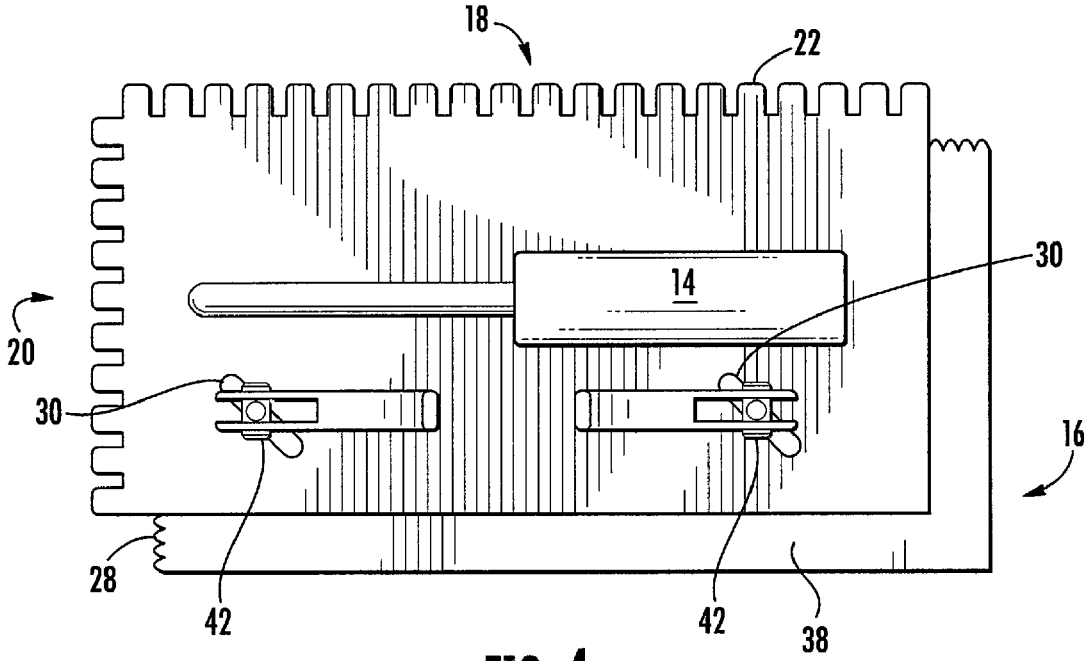
FIG. 4 is top view of the assembled trowel of FIG. 1, wherein the first plate is attached to the second plate by the cam clamp positioned at the furthermost end of the diagonal slot such that the adjacent side edges of first plate-like member extend over the second plate-like member.
Figure 5:
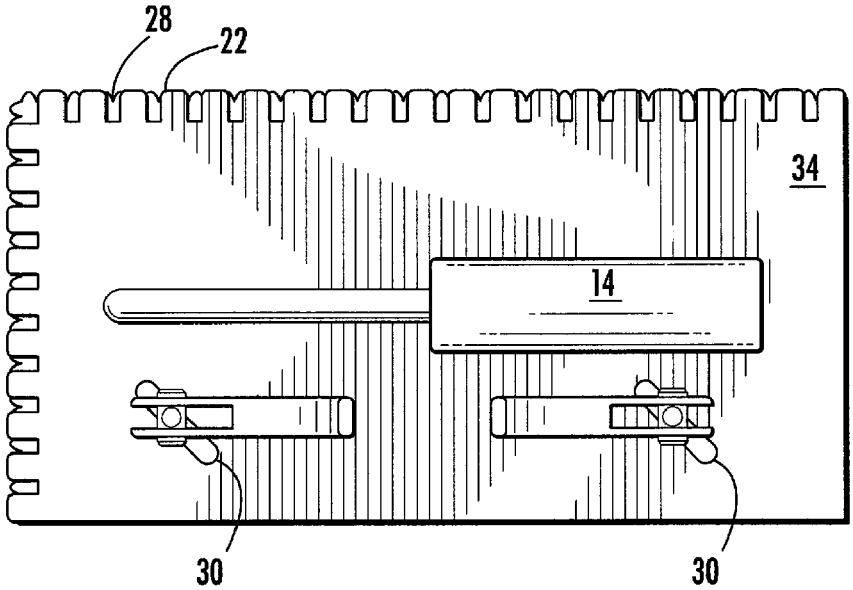
FIG. 5 is another top view of the assembled trowel of FIG. 1, wherein the first plate-like member is attached to the second plate-like member by the cam clamp such that the adjacent side edges of each plate overlap.
Figure 6:
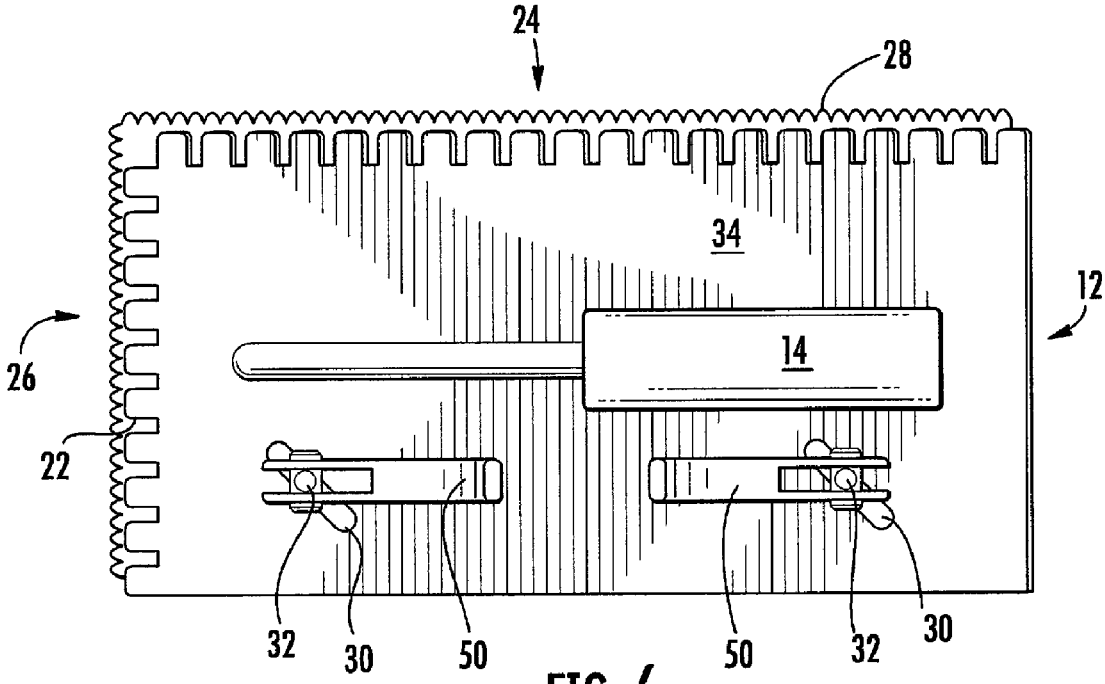
FIG. 6 is top view of the assembled trowel of FIG. 1, wherein the first plate is attached to the second plate by the cam clamp positioned at the furthermost end of the diagonal slot such the adjacent side edges of second plate-like member extend over the first plate-like member.

As illustrated in FIGS. 4-6, the depth of notches 22, 28 revealed by the plate-like members 12 and 16, respectively, can be adjusted by sliding the plates relative to one another as the shaft of the attached fasteners 32 are able to travel along the slots 30, which are formed at about 45 degrees relative to the edge 19. Once the desired depth (or shape) of notch is reached, each of the levers of the cam clamps 42 are pivoted to the closed position lock the plates relative to each other.

FIG. 4 shows an extreme position of the cam clamps 42 located at the one end of the slots 30. In this configuration, the plates are set to show the entirety of notches 22 on the adjacent edges 18, 20 which is suitable for applying a thick adhesive bed.

FIG. 5 shows one of the numerous intermediate positions wherein the cam clamps 42 are affixed in an approximately the middle of the slots 30 so that notches 22, 28 on the first and second plate 18, 20 overlap, to provide a shallower depth of spreadable material and/or change the shape of the resulting grooves.

FIG. 6 shows another extreme position opposite that observed in FIG. 4, wherein the cam clamps 42 are located at the one end of the slots 30. The plates are set to show the entirety of notches 28 on adjacent edges 18, 20 suitable for distributing a thin adhesive bed.

Referring now to an alternate embodiment illustrated in FIGS. 7-11, FIG. 7 shows an exploded upper perspective view of a second embodiment of the instant trowel assembly. As with the previous embodiment, this trowel assembly is capable of applying an even distribution of spreadable material onto a work surface. Moreover, this embodiment allows the worker to readily adjust the trowel between left- and right-handed configurations to access corresponding internal corners of the structure.

Figure 7:
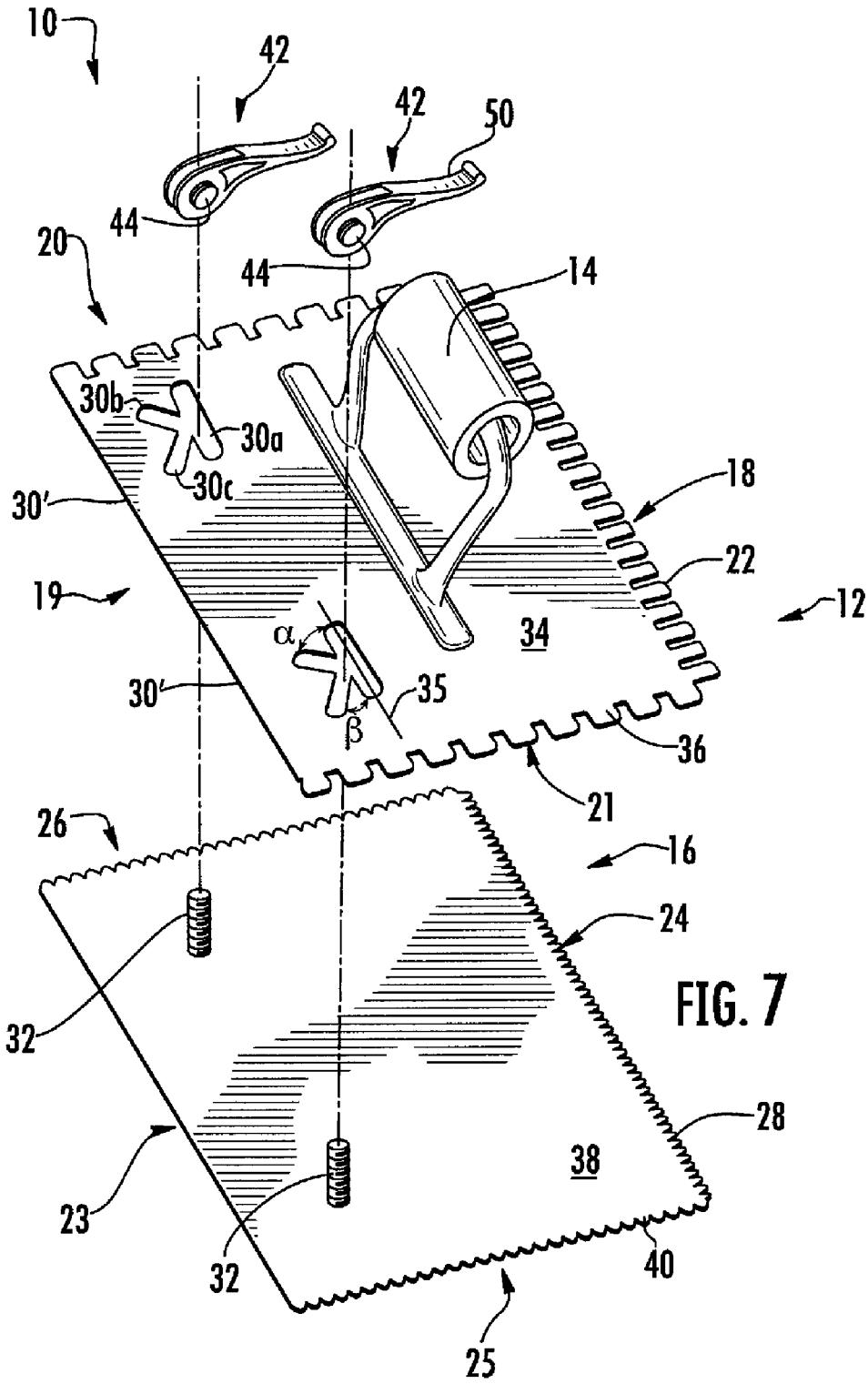
FIG. 7 is an upper perspective, exploded view of a trowel assembly according to a second embodiment of the present invention.

In the present embodiment of the trowel assembly, the first plate-like member 12 includes at least two (FIGS. 1-6) or three (FIGS. 7-11) adjacent edges 18, 20, 21, each having substantially rectangular notches 22 formed thereon. Moreover, the first plate-like member includes at least one multi-directional slot 30' formed therein. Although FIG. 7 is depicted as having two multi-directional slots, it is within the purview of the instant invention to provide a single multi-directional slot.

The multi-directional slot 30' comprises a plurality of interconnected cutout portions (30*a*, 30*b*, 30*c*). As shown herein, the first cutout portion 30*a* is substantially parallel to the edge 19 of the first plate-like member. The second cutout portion 30*b* is formed at a predetermined angle $\alpha$ with respect to the axis 35 of the first cutout 30*a*, for example, shown here as approximately 45 degrees. The third cutout portion 30*c* is formed at another predetermined acute angle $\beta$ relative to the axis 35 of the first cutout 30*a* (shown here as substantially equal to angle $\alpha$).

As with the first embodiment, the second embodiment of the trowel assembly 10 includes a second plate-like member 16 having an upper surface 38, a bottom surface 40 and two or three adjacent edges 24, 25, 26 with smaller serrated notches 28 formed thereon useful for installing smaller tiles. Again, the edge 23 of the second plate-like member is shown here without any notches formed therein, however, it is contemplated that this edge may also include notches without departing from the scope of the invention.

The second plate-like member 16 also includes at least one threaded fastener 32 (posts, studs, pins, bolts, etc.), constructed and arranged for receipt within the multi-directional slot 30' of the first plate-like member. The threaded fasteners are integrally connected to the upper surface 38 of the second plate-like member by any means of attaching known to the skilled artisan.

As with the first embodiment, the depth of notches 22, 28 revealed by the plate-like members 12, 16, respectively, can be adjusted by sliding the plates relative to one another as the shaft of the attached fasteners 32 are able to travel along the interconnected cutout portions (30*a*, 30*b*, 30*c*) of the multi-directional slot 30'. Once the notched side appropriate for left- or right-hand application is exposed, each of the levers of the cam clamps 42 is pivoted to the closed position to lock the plates relative to each other, as illustrated in FIGS. 8-11.

Figure 8:
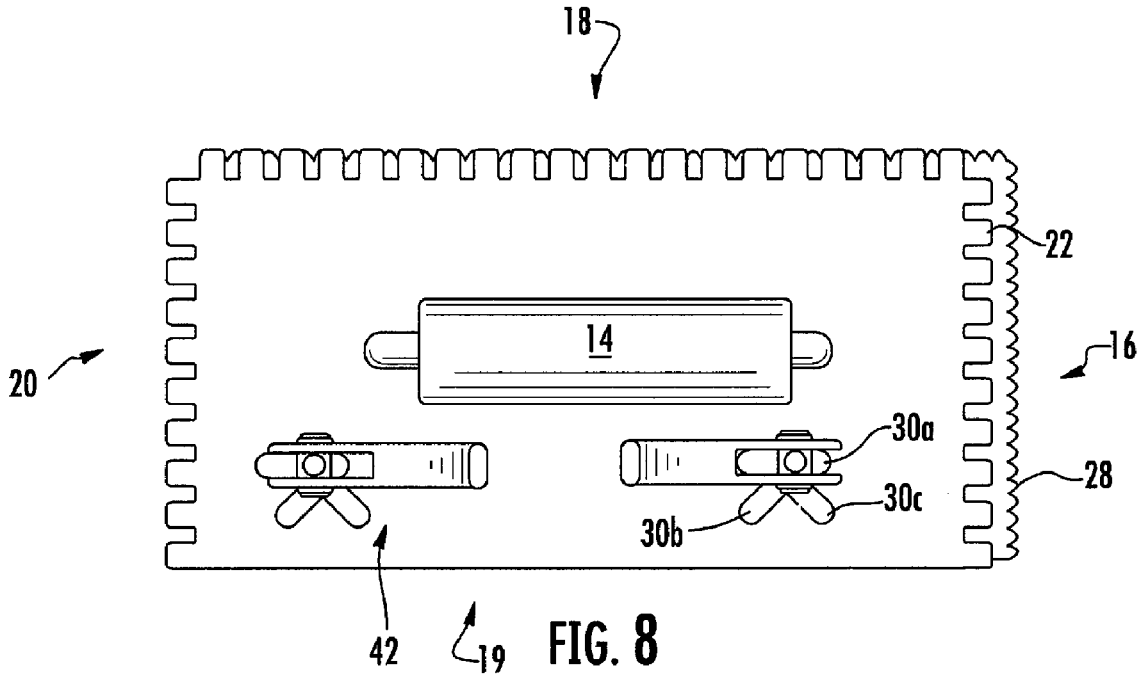
FIG. 8 is a top view of the second embodiment of the present invention illustrated in FIG. 7, wherein the cam clamps are located at the one end of the substantially horizontal cutout member of the multi-directional slot.

FIG. 8 illustrates a top view of the second embodiment, wherein the cam clamps 42 are located at one end of the substantially horizontal cutout member 30*a*. In this configuration, the plates expose the entirety of notches 22 on edge 20 for applying a thick adhesive bed. Notches 28 on opposite edge 16 are also exposed for applying a thin adhesive bed. In addition, notches 22, 28 on edge 18 are overlapped for creating the desired patterns in the adhesive.

Figure 9:
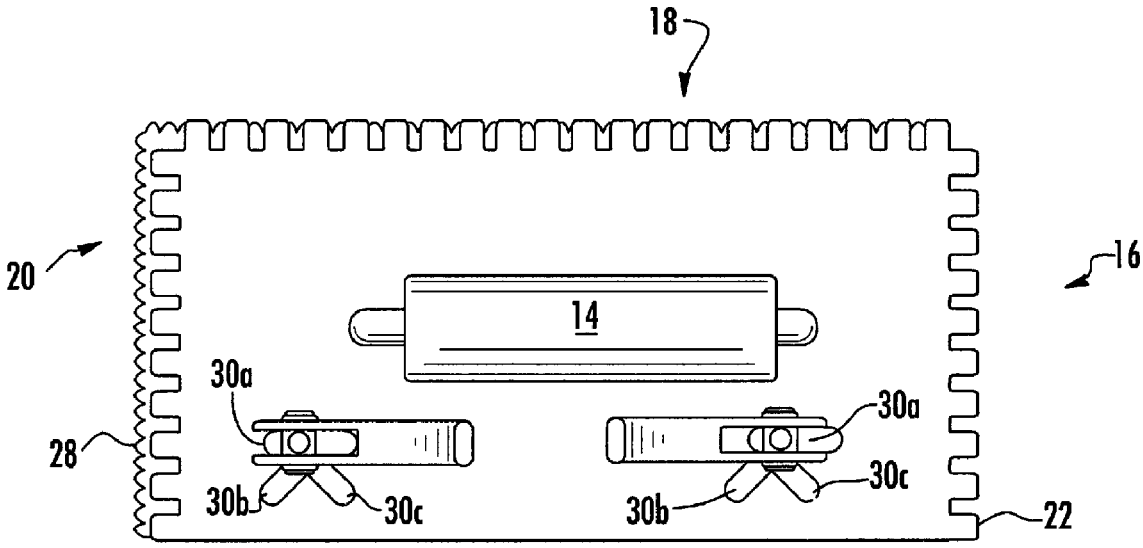
FIG. 9 is a top view of the second embodiment of the present invention, the cam clamps are affixed at the side directly opposite the horizontal cutout member illustrated in FIG. 8 for left- or right-handed use.

FIG. 9 illustrates a top view of the second embodiment, wherein the cam clamps 42 are affixed at the opposite side of the horizontal cutout member 30*a* exposing notches 22, 28 opposite that of the assembly shown in FIG. 8 for left- or right-handed use.

Figure 10:
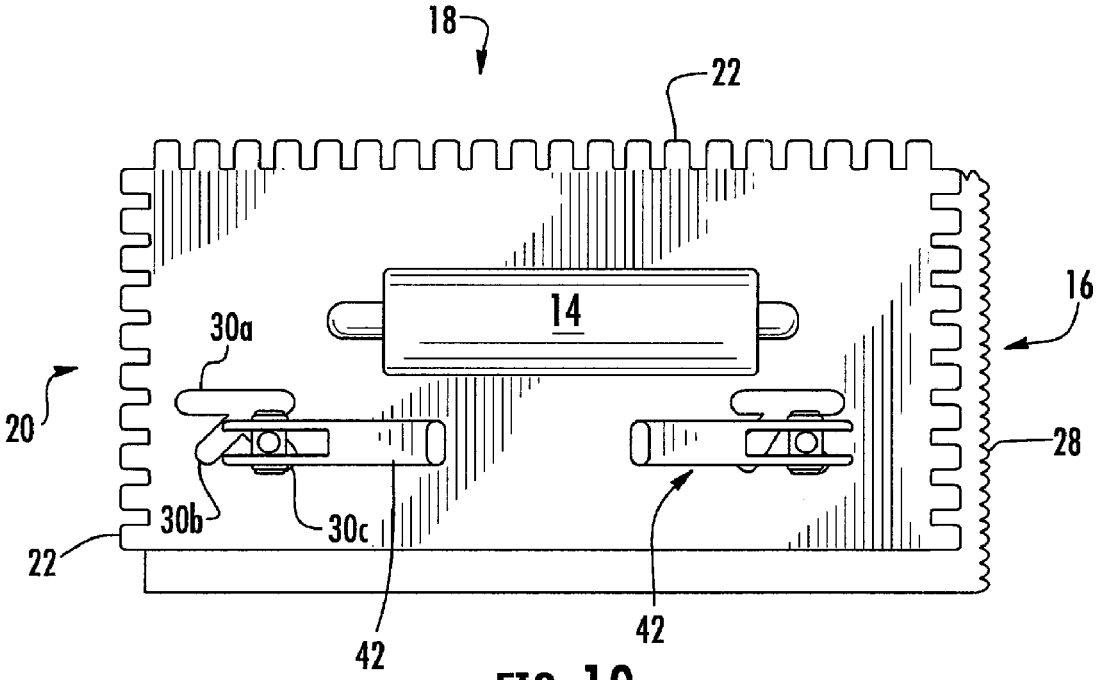
FIG. 10 illustrates a top view of the second embodiment, wherein the cam clamps are located at one end of the cutout portion 30*c*, wherein the entirety of notches on two adjacent edges on the first plate-like member are exposed for distributing an adhesive bed for right-handed applications.

FIG. 10 illustrates a top view of the second embodiment, wherein the cam clamps 42 are located at one end of cutout portion 30*c*. In this configuration, the plates show the entirety of notches 22 on adjacent edges 18, 20, which is particularly suitable for distributing a thick adhesive bed during right-handed use.

Figure 11:
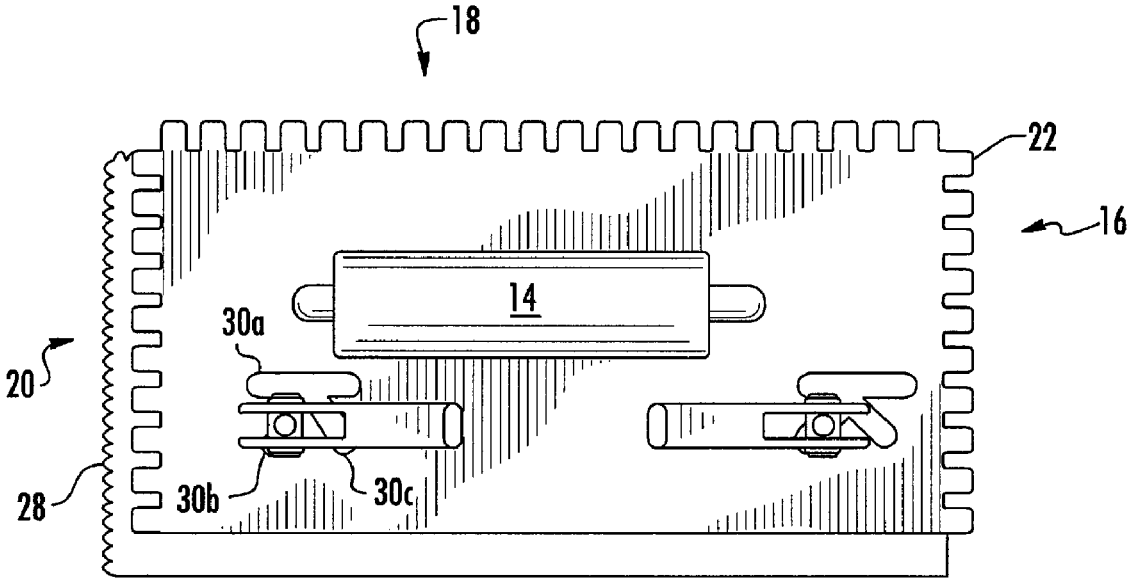
FIG. 11 illustrates a top view of the second embodiment, wherein the cam clamps are located at the one end of the cutout portion 30*b*, wherein the entirety of notches on two adjacent edges on the second plate-like member are exposed for distributing an adhesive bed for left-handed applications.

FIG. 11 illustrates another top view of the second embodiment, wherein the cam clamps 42 are disposed within slots 30*b*. The plates are set to show the entirety of notches 22 on adjacent edges 16, 18 suitable for distributing a thick bed of adhesive during left-handed use.

Referring now to a third embodiment of the present invention, illustrated in FIGS. 12-17, FIG. 12 shows the first plate-like member provided with at least one enlarged and substantially rectangular cut-out 30*d* (two cutouts shown). Unlike the slot configurations described above, which limit the adjustment of the two plate-like members along predetermined slots, these enlarged cutouts allow for a nearly infinite adjustment and notch overlap between the first and second plates. Although the cutouts are depicted here as substantially rectangular, any other shape could be used without departing from the scope of the invention, e.g., circular, oval, rhomboidal or square configuration.

As with the previous embodiments, the trowel assembly is capable of applying an even distribution of spreadable material onto a work surface. The second plate-like member 16 has number of fastening means 32*a* (e.g., posts, studs, pins, bolts or the like) extending upward therefrom. The number and location of the fastening means correspond to the enlarged cutouts. The fastening means may be threaded like those depicted in FIGS. 1-11, or non-threaded like those illustrated in FIG. 13*b*. The fasteners 32*a* are integrally attached to the upper surface of the second plate by any means of attaching known to the skilled artisan. Each of the fastening means in this embodiment includes a slot 70 formed therethrough, along their longitudinal axis. The slot is constructed and arranged to slidingly receive a pin, post, or the like therein, as discussed further below.

Figure 14B:
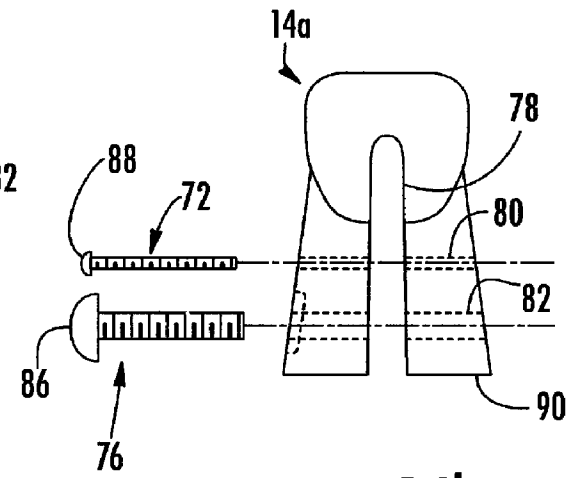
FIG. 14*b* is a front side view of the handle depicted in FIG. 14*a;*
Figure 14A:
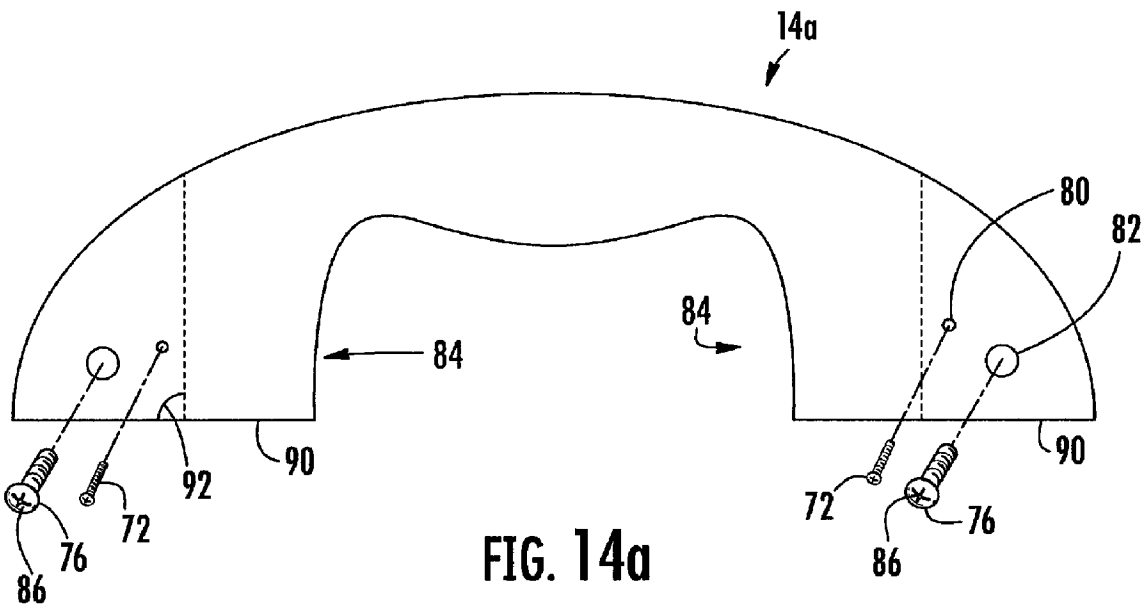
FIG. 14*a* is a side view of the trowel handle shown disconnected from the plate-like members.

In this particular embodiment, the trowel assembly also includes a modified handle 14*a* (see FIGS. 14*a* and 14*b*). Unlike the aforementioned embodiments described above, this handle is not integrally connected to the first plate-like member; rather, the handle is slidingly attached to the fastening means 32*a* (see FIGS. 15 and 16). The handle includes a first aperture 80 and a second aperture 82, both extend therethrough (see FIG. 14*b*). In addition, the handle includes a slot 78 that divaricates each of the legs 84 of the handle. The slot is constructed and arranged to pivotally receive a cam clamp 42*a* therein. As shown in FIG. 14*a*, the slot is formed with at a particular angle 92 relative to the handle base 90. The slot angle should allow the cam clamp 42*a* able to fully pivot when attached to the handle. The cam clamp includes an aperture 74 (FIG. 17) within the cam portion of clamp, the aperture is constructed and arranged to receive a pivotal attachment means 76, e.g., a bolt, pin, screw, or the like therethrough, to pivotally attach the clamp to the handle.

Upon assembly, the cam clamp is placed inside the slot 78 formed inside the handle. The pivotal attachment means 76 is then guided through both the handle aperture 82 and cam clamp aperture 74, thereby pivotally attaching the cam clamp to the handle. In a similar manner, the fastening means 32*a* is slidingly attached to the handle 14*a* as well. That is, the fastener attachment means 72 (pin, screw, bolt, etc) is guided through both the aperture 80 in the handle and the slot 70 formed in the fastener 32*a*. The fastener attachment means 72 should be sized so that it easily slides within slot 70 of the fastener.

According to a preferred embodiment, pivotal attachment means and fastener attachment means both include a tool opening 86, 88 respectively, which remains accessible after assembly the trowel so that it may be completely dissembled periodically for more thorough cleaning if needed. Alternatively, the pivotal attachment means and fastener attachment means may be permanently installed by the manufacturer so the user cannot dissemble it. The fastener attachment 72 prevents the first and second plates of the assembly from becoming completely separated when the cam clamp is opened (see FIG. 15), thereby reducing the possibility of the trowel components getting lost during normal use. In like manner, the pivotal attachment means keeps the cam clamp attached to the handle so that it does not get lost during cleaning.

Figure 15:
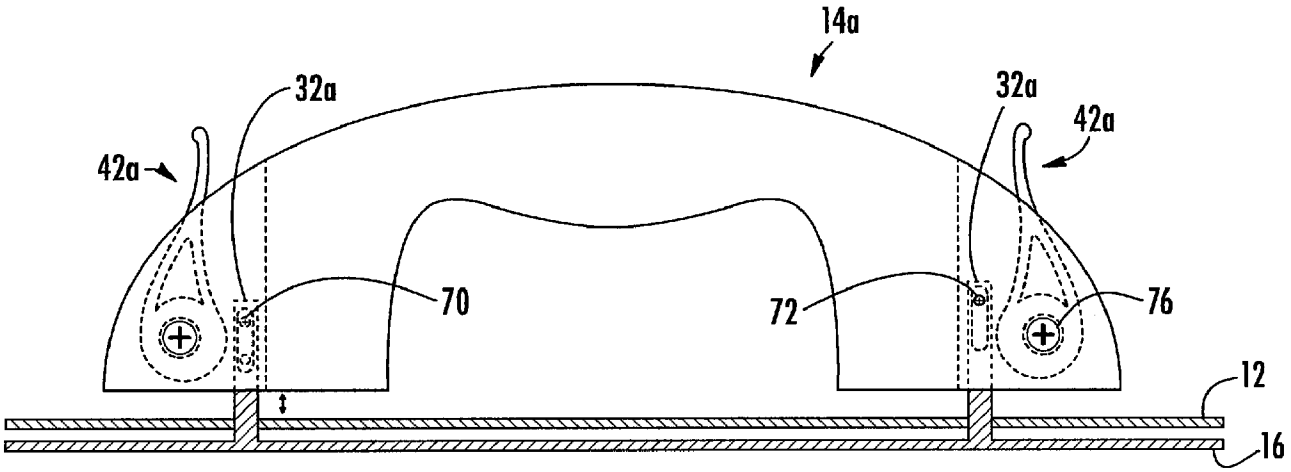
FIG. 15 is a side view of the trowel assembly of the third embodiment, wherein the cam clamp is in an open position, such that the first and second plate-like members are not affixed relative to each other.
Figure 16:
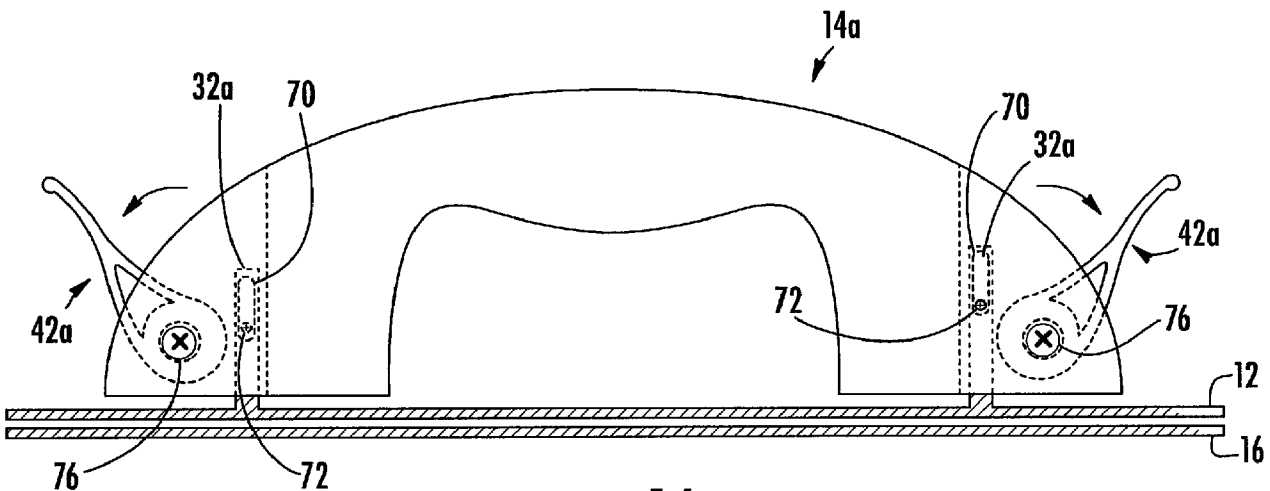
FIG. 16 is the same side view of the trowel assembly shown in FIG. 15, wherein the cam clamp is in a closed position, such that the first and second plate-like members are affixed relative to each other.
Figure 17:
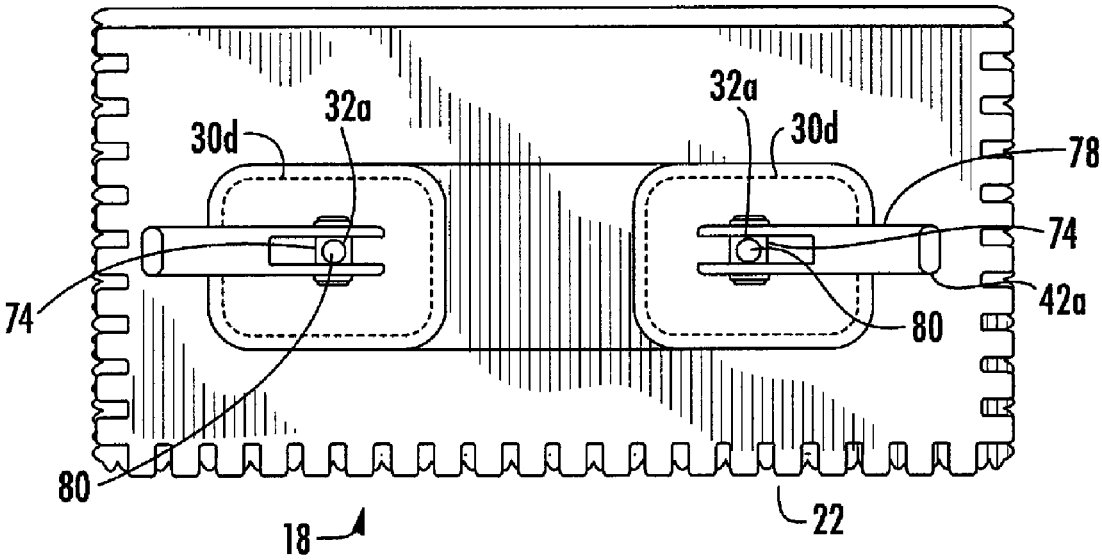
FIG. 17 is top view of the assembled trowel of the third embodiment, wherein the first plate is attached to the second plate by the cam clamps.

Upon assembly, the first plate-like member 12 is positioned above the second plate-like member 16 such that the fasteners 32*a* on the second plate-like member extend through the cutouts 30*d* (see FIGS. 15 and 16). With the cam clamps in the "open" position shown in FIG. 15, the plates are easily maneuvered along parallel planes within the enlarged cutouts 30*d* until the desired amount of notch overlap is achieved (see for example, FIG. 17). Then, the user presses the two plates together so that the fastener attachment means 72 slides to the lower portion of the fastener slot 70 and pivots the lever portion 50 of the cam clamp about the axis defined by the cam attachment means 76 until the gradual curved surface of cam throw frictionally engages the fastener in a "closed" position as shown in FIG. 16. Thus, the handle base 90 pressed flush against the top surface of the first plate-like member 12, and the first plate-like member is tightly sandwiched between the handle and the second plate-like member 16. After use, the cam clamps are rotated into the "open" position shown in FIG. 15, and the fastener attachment means 72 slides to the upper portion of the fastener slot 70. The plates are then easily separated by lifting the first plate-like member so that any spreadable material that may have gotten in between the two plate-like members is readily cleaned.

The third embodiment depicted in FIGS. 12-17, is particularly advantageous as the handle substantially encloses the cam clamp and the fastening means, thereby protecting the user from the moving parts of the cam clamp. Moreover, the substantially hidden cam clamps are aesthetically more appealing in that they closely resemble currently commercially available trowels comprising a single plate.

Although in all of the aforementioned embodiments the plate-like members 12, 16 are depicted as rectangular, the shape of the plate-like members is not limited thereto. Other possible shapes include, albeit not limited to, rhomboidal, square or the like. Additionally, either or both of the plate-like members can be constructed from any durable material including, albeit not limited to, an elastomeric material, polymeric material, wood, metal, or combination thereof. Similarly, the handle 14 of any of the aforementioned embodiments can be constructed from any durable material known to those skilled in the art, including wood, metal, elastomeric, polymeric materials or combinations thereof. The handle can also include ergonomic gripping indentions formed therein to provide comfortable handling, as is well known in the art.

Figure 18:
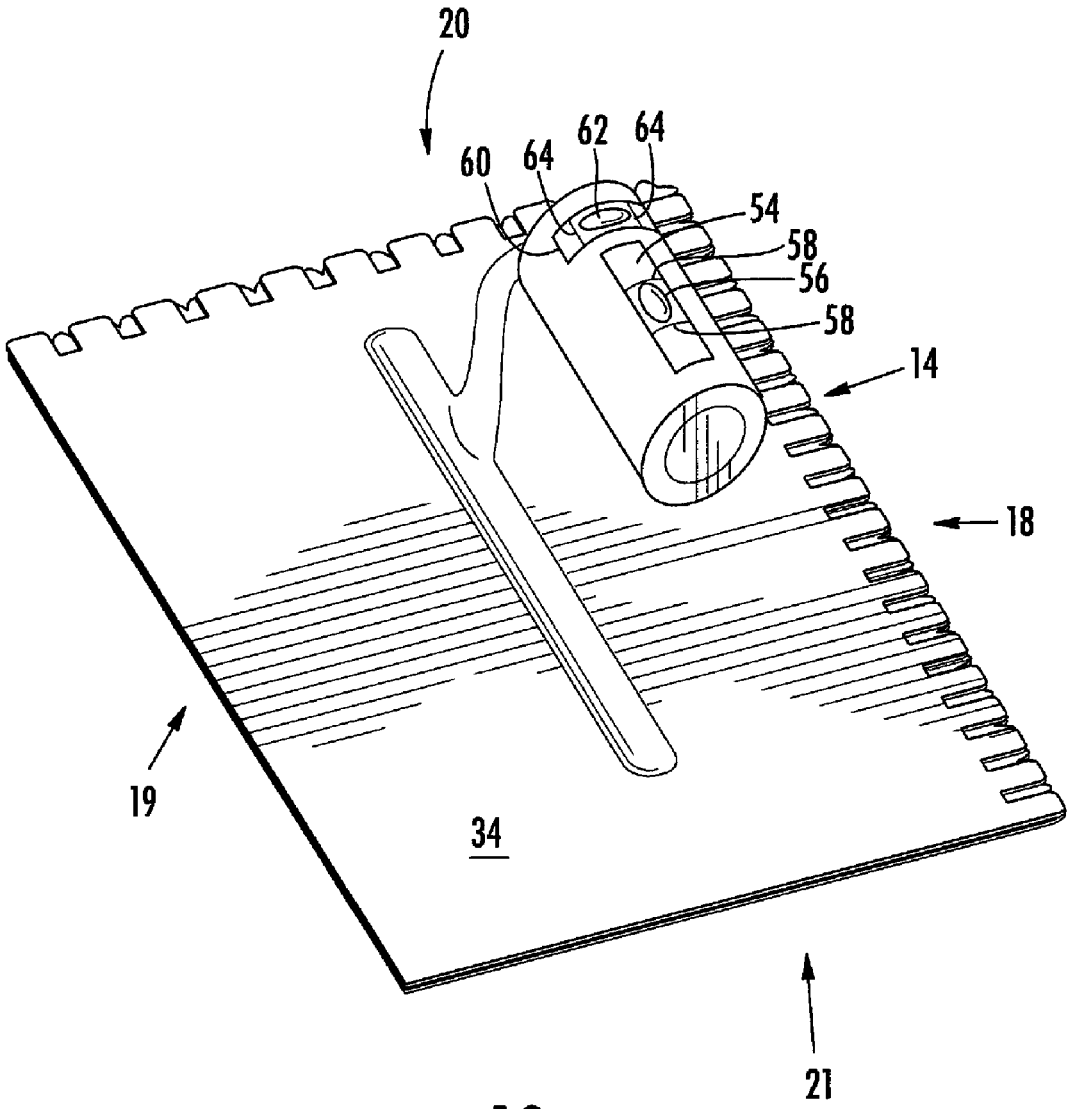
FIG. 18 is an upper perspective view of an alternate embodiment of the trowel assembly having two level indicating means in the handle.

Referring now to FIG. 18, any of the aforementioned embodiments of the trowel assembly may include a first level indicating means 54 integrally attached to the upper surface along the longitudinal axis of the handle, or attached to the upper surface 34 of the first plate-like member (not shown). The level indicating means includes a gas bubble 56 suspended in a fluid encapsulated within a housing, as is well known in the art. The housing has indicia 58 on each side calibrated to indicate when one of the sides of the trowel assembly, preferably a side without notches, is placed flush against a horizontal work surface and the bubble becomes centered between the indicia, then the trowel is level (i.e., substantially horizontal with respect to the earth).

In addition, the trowel assembly can also include a second level indicator 60 substantially identical to the first but located along a different plane (i.e., perpendicular) than the first level indicator 54. The second level indicator 60 will indicate whether the trowel assembly is plumb (i.e., substantially perpendicular with respect to the earth). The user places the bottom surface 40 of the second plate-like member against a vertical work surface to determine whether the bubble 62 falls between the two indicia 64.

Although in the aforementioned examples the first plate-like member possesses larger notched edges and the second plate-like member has serrated edges, it will be understood to those of ordinary skill that the second plate-like member could comprise larger notched edges and the first plate-like member could include serrated (or other shaped) edges. Moreover, it is contemplated herein that the adjacent edges 18, 20, 21 of the first plate could include different sized and/or shaped notches, respectively. Similarly, the adjacent edges 24, 25, 26 of second plate 16 could also include different sized and/or shaped notches than that those of the first plate.

In yet another embodiment, not shown, at least one cam clamp could include integrally connected spreader arms formed perpendicular to the vertical axis of the clamp, which upon actuation of the arm reciprocally engage two corresponding fasteners integrally attached to the upper surface of the second plate-like member to fasten the first and second plates relative to each other.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims.

Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A trowel assembly for applying spreadable material to a work surface comprising:

a first plate-like member having an upper surface, a bottom surface, and a pair of spaced apart side edges, wherein at least two side edges include a plurality of notches, said first plate-like member having at least one cutout formed therein;

a second plate-like member having an upper surface, a bottom surface, and a pair of spaced apart side edges wherein at least two adjacent side edges include a plurality of notches, said second plate-like member having substantially the same dimensions as said first plate-like member, said upper surface of said second plate-like member having at least one integrally connected fastening means projecting upward, therefrom;

a handle in slidable connection to at least one said fastening means; and at least one cam clamp pivotally connected to said handle and constructed and arranged to releasably couple with said fastening means to permit sliding attachment of said first plate-like member relative to said second plate-like member along parallel planes to provide the desired amount of overlap between corresponding said notched side edges of said first plate-like member and said notched side edges of said second plate-like member;

wherein translation of one of said plate-like members with respect to the other serves to vary the amount of overlap of notches along the adjacent edges of said first and second plate-like members, thereby varying depth and/or shape of said spreadable material being applied by said trowel assembly.

2. The trowel assembly as set forth in claim 1, wherein said first and second plate-like members are of a shape selected from the group consisting of a substantially rectangular, rhomboidal, or square configuration.

3. The trowel assembly as set forth in claim 1, wherein said first plate-like member and said second plate-like member comprise different sized of notches along their respective edges.

4. The trowel assembly as set forth in claim 1, wherein said first plate-like member and said second plate-like member comprise different shaped of notches along their respective edges.

5. The trowel assembly as set forth in claim 4, wherein said shape of said notches are selected from the group consisting of scalloped, square, rectangular, or v-shaped.

6. The trowel assembly as set forth in claim 1 in which said handle includes at least one level indicating means integrally connected thereto;

whereby the user can place one of said surfaces of said trowel assembly against said work surface to determine the orientation of said work surface with respect to the earth.

7. The trowel assembly as set forth in claim 1 wherein said first plate-like member is constructed from a material selected from the group consisting of elastomeric material, polymeric material, wood, metal, or combinations thereof.

8. The trowel assembly as set forth in claim 1 wherein said second plate-like member is constructed from a material selected from the group consisting of elastomeric material, polymeric material, wood, metal, or combinations thereof.

9. The trowel assembly as set forth in claim 1, wherein said enlarged cutout is of a shape selected from the group consisting of a substantially rectangular, rhomboidal, square, circular, or oval configuration.

10. The trowel assembly as set forth in claim 1 wherein said handle is constructed from a material selected from the group consisting of elastomeric material, polymeric material, wood, metal, or combinations thereof.

11. A trowel assembly for applying spreadable material to a work surface comprising:

a first rectangular shaped plate-like member having an upper surface, a bottom surface, and a pair of spaced apart side edges, wherein at least two side edges include a plurality of notches, said first plate-like member having at least one substantially square cutout formed therein;

a second rectangular shaped plate-like member having an upper surface, a bottom surface, and a pair of spaced apart side edges wherein at least two adjacent side edges include a plurality of notches, said second plate-like member having substantially the same dimensions as said first plate-like member, said upper surface of said second plate-like member having at least one integrally connected fastening means projecting upward, therefrom;

a handle in slidable connection with said fastening means; and at least one cam clamp pivotally connected to said handle and constructed and arranged to releasably couple with said fastening means to permit sliding attachment of said first plate-like member relative to said second plate-like member along parallel planes to provide the desired amount of overlap between corresponding said notched side edges of said first plate-like member and said notched side edges of said second plate-like member;

wherein translation of one of said plate-like members with respect to the other serves to vary the amount of overlap of notches along the adjacent edges of said first and second plate-like members, thereby varying depth and/or shape of said spreadable material being applied by said trowel assembly.

12. The trowel assembly as set forth in claim 11, wherein said first plate-like member and said second plate-like member comprise different sized of notches along their respective edges.

13. The trowel assembly as set forth in claim 11, wherein said first plate-like member and said second plate-like member comprise different shaped of notches along their respective edges.

14. The trowel assembly as set forth in claim 13, wherein said shape of said notches are selected from the group consisting of scalloped, square, rectangular, or v-shaped.

15. The trowel assembly as set forth in claim 11 wherein each said plate-like member is constructed from a material selected from the group consisting of elastomeric material, polymeric material, wood, metal, or combinations thereof.

* * * * *